US007134897B1

(12) United States Patent
Ju

(10) Patent No.: US 7,134,897 B1
(45) Date of Patent: Nov. 14, 2006

(54) ELECTRIC CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/217,325

(22) Filed: Sep. 2, 2005

(51) Int. Cl.
*H01R 13/62* (2006.01)

(52) U.S. Cl. ..... 439/330

(58) Field of Classification Search ..... 439/68–73, 439/330–331
See application file for complete search history.

(56) References Cited

U.S. PATENT DOCUMENTS

2004/0166714 A1* 8/2004 Huang ..... 439/330

* cited by examiner

*Primary Examiner*—Ross Gushi
(74) *Attorney, Agent, or Firm*—Troxell Law Office, PLLC

(57) ABSTRACT

An electric connector for connecting a chip to a circuit board comprises an insulating body having an elastic buckle device extended from one side of the insulating body and an retaining buckle device extended from another side of the insulating body for positioning the chip to the electric connector; and a plurality of terminals. After a least one terminal is pressed properly and conducted with at least another one terminal, a PDA on the chip is connected with a chip on the PDA of the circuit board by a plurality of the terminals. The electric connector is used to facilitate several functions (such as signal transmission and removing static electrons) of a PDA on the circuit board so as to simplify the configuration of the circuit board and reduce manufacturing costs.

7 Claims, 4 Drawing Sheets

ELECTRIC CONNECTOR

BACKGROUND OF THE INVENTION (a) Field of the Invention

The present invention relates to connectors, and particularly to an electric connector for connecting a chip to a circuit board.

(b) Description of the Prior Art

With the improvement of technology, operation speeds of computer chips become more and more quick and the amounts of the data transmissions by the chips increases more and more plentifully. Because of the time of computer operation increases continuously, the computer chips produce a huge amount of static electrons accompanying with extending computer work time. Besides, the static electrons disappears automatically in a shot time period. According to prior arts, an electric connector used for connecting a chip to circuit board includes an insulating body, a plurality of signal terminals and a grounding terminal. The signal terminals and the grounding terminal are received in the insulating body. The signal terminals are in contact with a PDA of the circuit board. By connecting the chip to the circuit board, the signal is transmitted between the chip and the circuit board. The grounding terminal is in contact to the grounding terminal of the circuit board so as to remove static electrons. However, the prior art way for removing static electrons by adding a grounding terminal on the circuit board is limited by the configuration of the circuit board. In other words, the grounding terminal is incapable of being added freely. In this situation, because static electrons on the circuit board are incapable of being removed efficiently, the signals between the chip and the circuit board are not transmitted normally. Besides, the lifetime of the chip is shorten greatly. Also, to add an extra grounding terminal will increase the complexities of the manufacturing process of the circuit board and increase the manufacturing costs.

Therefore, it is necessary to develop a novel of electric connector so as to overcome the above-mentioned defects.

SUMMARY OF THE INVENTION

Accordingly, the primary object of the present invention is to provide an electric connector. The electric connector serves for connecting a chip to a circuit board and comprises: an insulating body having an elastic buckle device extended from one side of the insulating body and an retaining buckle device extended from another side of the insulating body for positioning the chip to the electric connector; and a plurality of terminals. After a least one terminal is pressed properly and conducted with at least another terminal, a PDA on the chip is connected with a chip on the PDA of the circuit board by a plurality of the terminals.

Comparing with prior arts, the electric connector is used to facilitate several functions (such as signal transmission and removing static electrons) of a PDA on the circuit board so as to simplify the configuration of the circuit board and reduce manufacturing costs.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
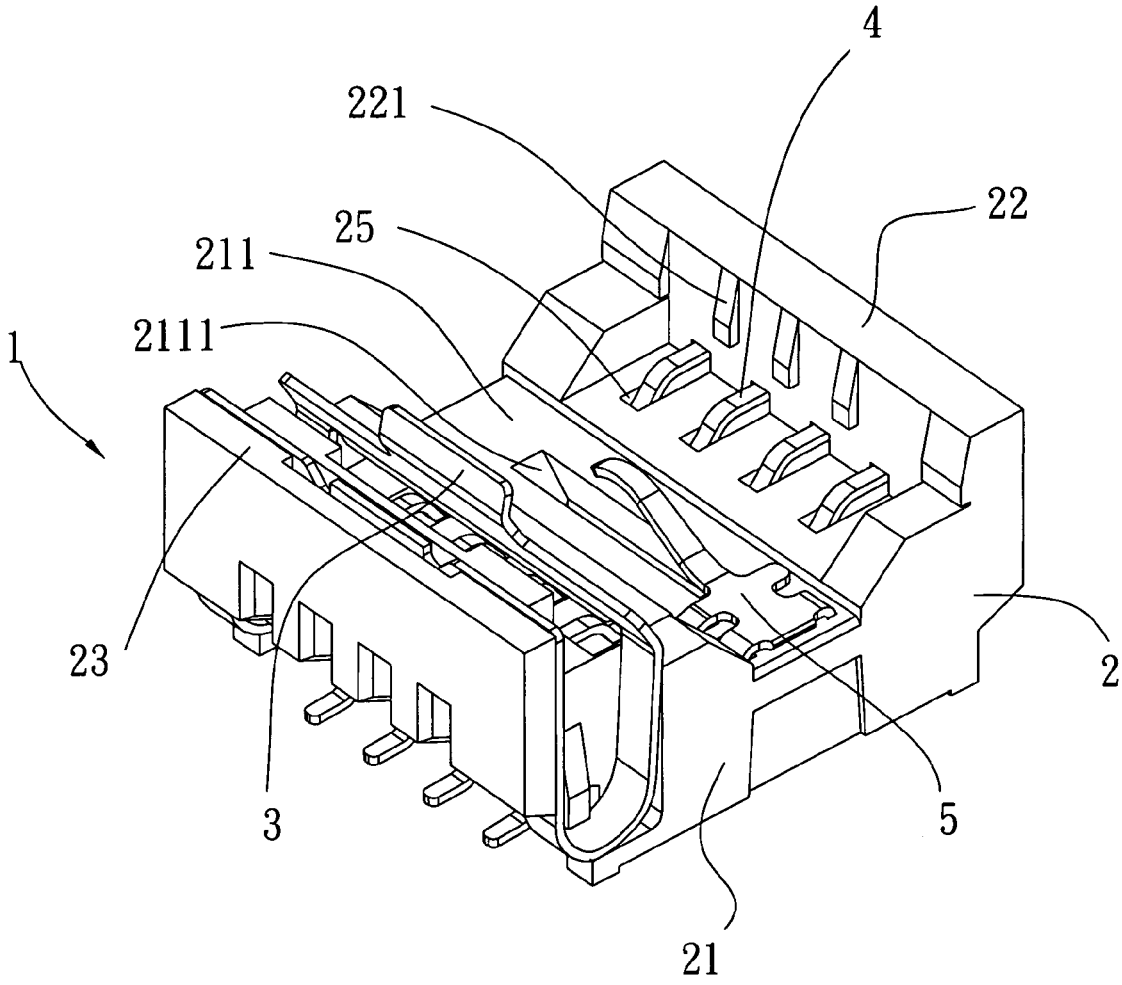
FIG. 1 is a perspective view of the electric connector of the present invention.
Figure 2:
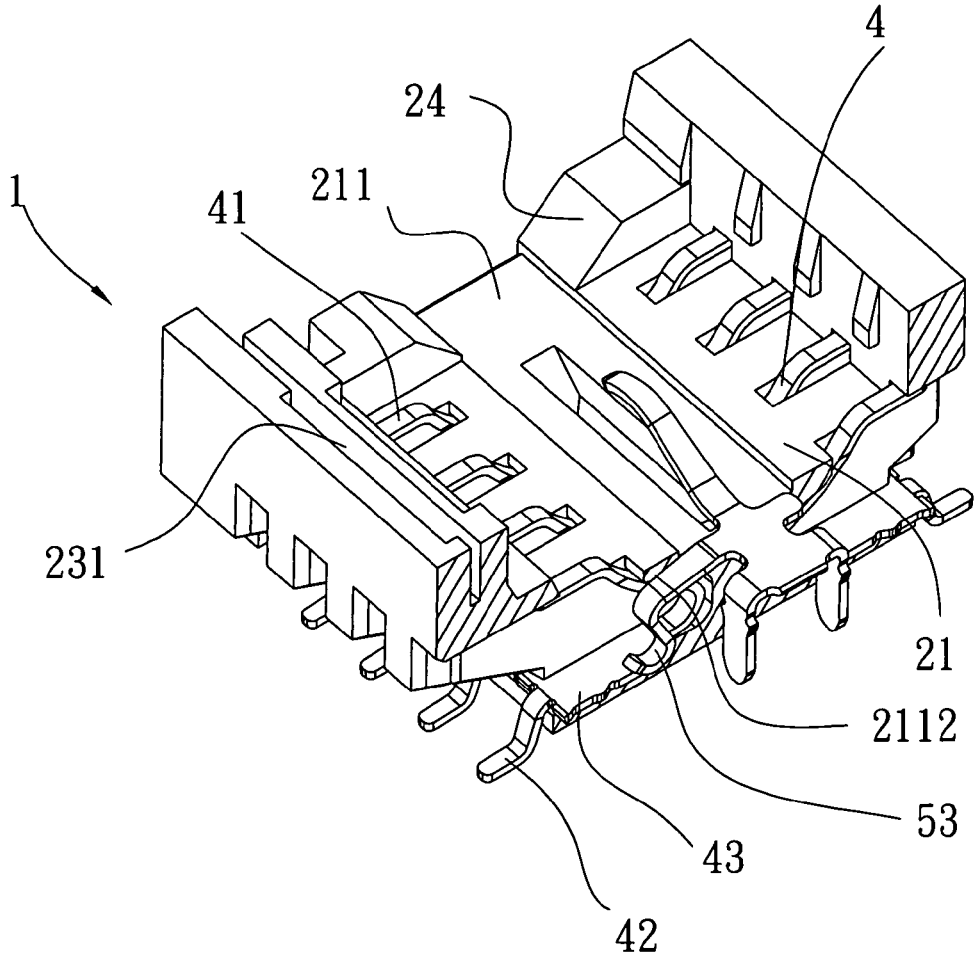
FIG. 2 is a cross-sectional view of the electric connector of the present invention.
Figure 3:
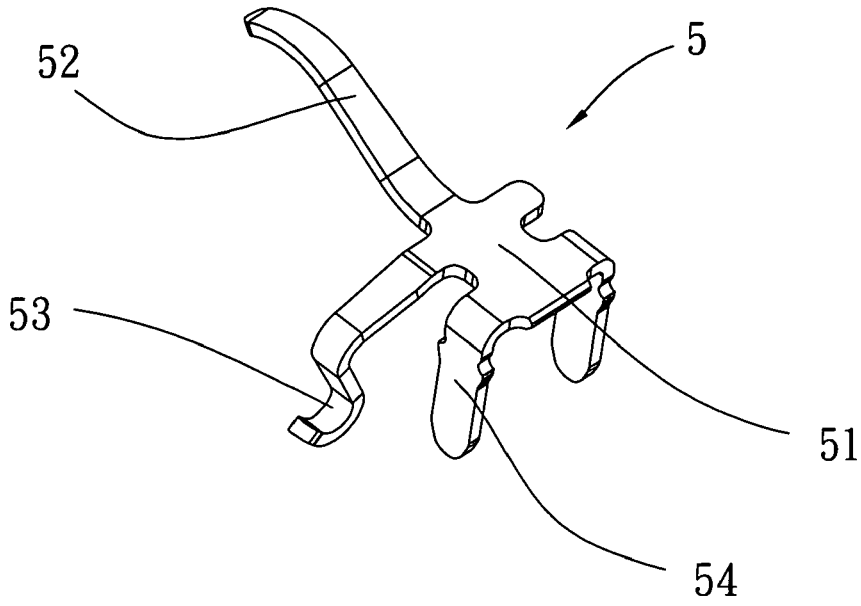
FIG. 3 is a perspective view of the grounded terminal of the electric connector of the present invention.
Figure 4:
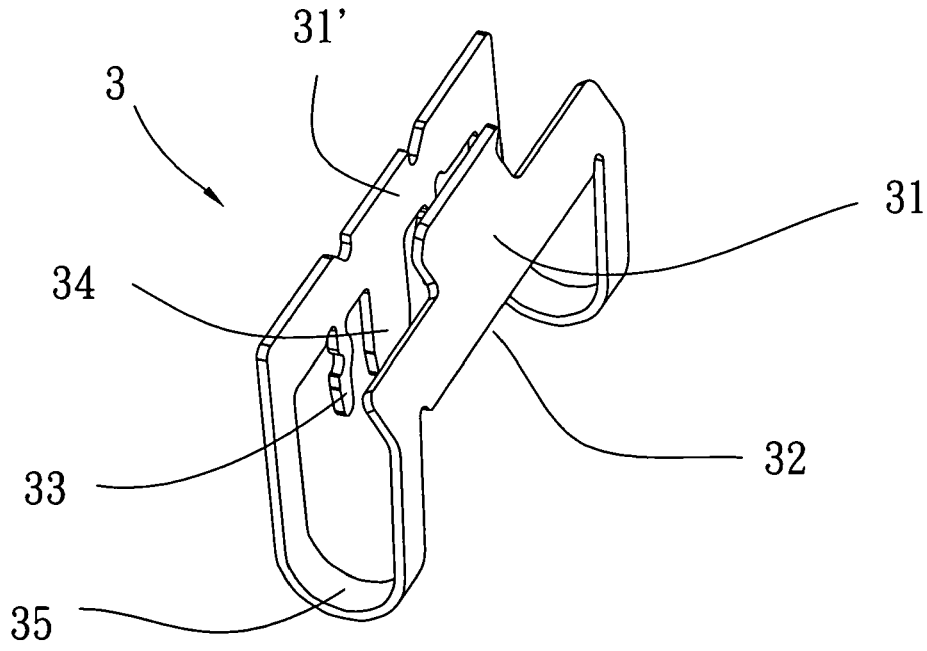
FIG. 4 is a perspective view of the metal buckle of the electric connector of the present invention.
Figure 5:
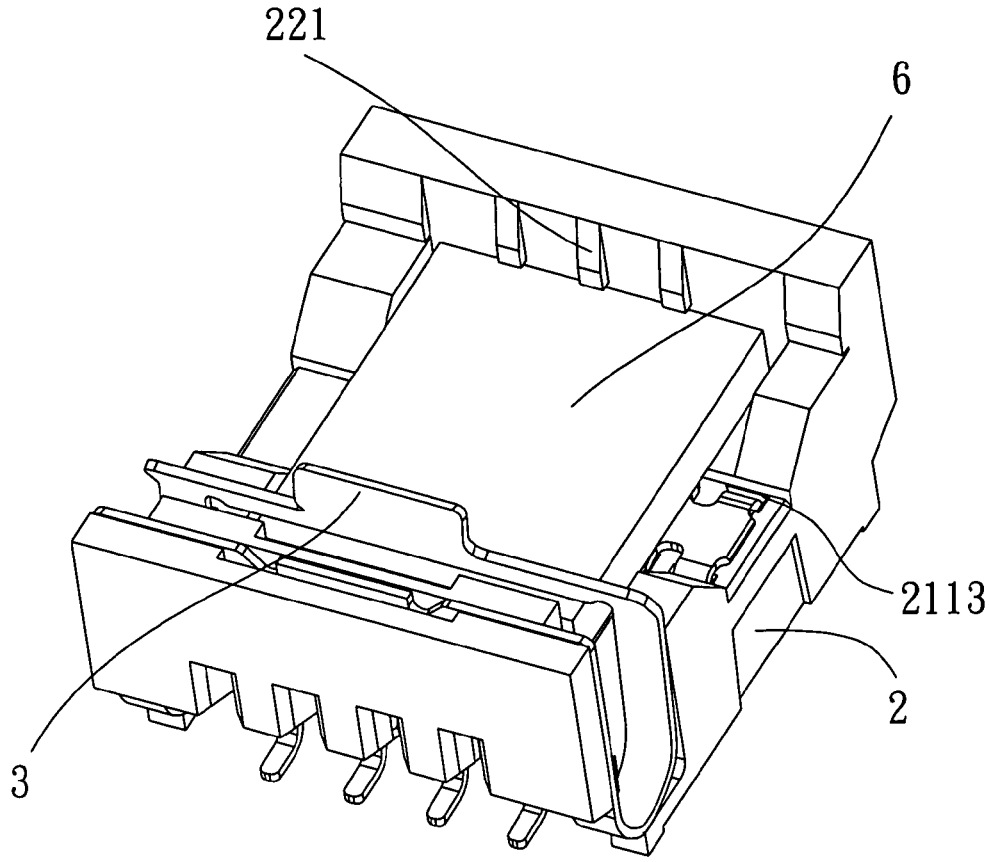
FIG. 5 is a perspective view showing that the electric connector is installed with the chip.

With reference to FIGS. 1 and 5, the electric connector of the present invention is illustrated. The electric connector 1 of the present invention is used to connect a chip 6 to a circuit board (not shown). The electric connector 1 includes an insulating body 2, a plurality of signal terminals 4, a grounded terminal 5 and a metal buckle 3.

The insulating body 2 has main body 21 and a first lateral wall 22 extended upwards from the main body 21. A plurality of hooking blocks 221 are protruded from the first lateral wall 22 for confining the movement of the chip 6 in vertical direction. Another side of the main body 21 is extended with a second lateral wall 23. A retaining groove 231 is formed on the second lateral wall 23 for fixing the metal buckle 3. Each of the four corners of the two lateral walls of the main body 21 are extended with a positioning portion 24 for confining the movement of the chip 6 in horizontal direction. A center of the main body 21 is concavely formed with a trench 211 for receiving the grounding terminal 5. A first terminal receiving slot 2111, a second terminal receiving slot 2112 and two grounding terminals 2113 are formed on the trench 211. Two banks of third terminal receiving slots 25 for receiving signal terminals 4 are located between the two lateral walls of the main body 21, respectively.

The signal terminals 4 are connected to the chip 6 and a circuit (not shown) for transmission signals and removing static electrons. Each of the signal terminals 4 comprises a protruding conductance portion 41 on the surface of the main body 21 of the insulating body 2; a welding portion 42 under the main body 21 welded with the circuit board (not shown); and a retainer 43 connected between the conductance portion 41 and the welding portion 42. The retainer 43 is firmly secured in the insulating body 2 for fixing the signal terminals 4.

The grounded terminal 5 is received in the hooking blocks 221. The grounded terminal 5 has a flat base 51; an elastic contact arm 51 extended inclinedly upwards from the base 51 and conducted with a grounding point (not shown) of the chip 6; a curve contact portion 53 extended downwards from one closed side of the elastic contact arm 52 of the base 51;

and a fastened portions 54 extended downwards form a farther side of the elastic contact arm 52 of the base 51. The contact portion 53 is received in a second terminal-receiving slot 2112. Before the chip 6 is installed, the contact portion 53 has contacted at least one signal terminal 4 for removing static electrons produced by the chip 6. The fastened portion 54 is received in the two grounding terminals 2113 of the trench 211 for fastening the grounded terminal 5.

The metal buckle 3 is received in the retaining groove 231. The metal buckle 3 includes two substrates, 31 and 31'. The substrate 31 has a hooking portion 32 matched with the hooking blocks 221 for confining the movement of the chip 6 in vertical direction. The substrate 31' has downwards installed with a first retainer 33 and a second retainer 34 for firmly retaining the metal buckle 3 in the retaining groove 231 of the insulating body 2. A U shape connecter 35 is connected between the substrate 31 and the substrate 31'.

In operation, firstly, the chip 6 is placed in a receiving chamber formed by two lateral walls of the main body 21 of the insulating body 2 and the four positioning portions 24. Another side of the chip 6 is positioned under the hooking blocks 221 of the insulating body 2. Then, by pushing the other side of the chip 6, the elastic contact arm 51 is received downwards in the first terminal receiving slot 2111 because of elastic deformation. When the chip 6 reaches to the hooking portion 32 of the metal buckle 3, the hooking portion 32 will block to the chip 6 and position the chip 6 with hooking blocks 221 of the insulating body 2 to the insulating body 2. Spacers (not shown) on the bottom of the chip 6 are in contact with the conductance portion 41 of the signal terminals 4 by elastically compression. The grounding point (not shown) is in contact with elastic contact arm 52 of the grounded terminal 5 by electrically compression. Thereby, static electrons are removed by passing through the signal terminals 4. Not only the signal transmission between the chip 6 and the circuit board are accomplished, but also the transient static electrons produced by the chip 6 are removed by signal terminals 4. Therefore, the two purposes of signal transmission and removing static electrons are achieved.

Figure 6:
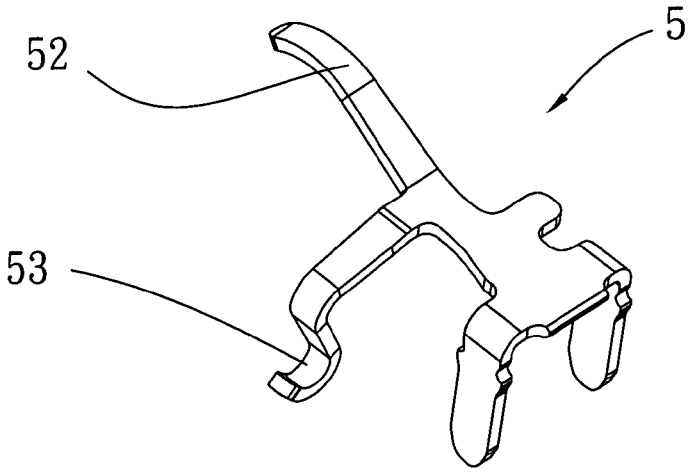
FIG. 6 is a perspective view of the grounded terminal of the electric connector of another embodiment of the present invention.

FIG. 6 is another embodiment of the present invention, wherein the contact portion 53 of the grounded terminal 5 is extended downwards from one side of the elastic contact arm 52. Before the chip 6 is positioned, the contact portion 53 of the grounded terminal 5 is not in contact with the signal terminals 4. During the process of pushing the chip 6, the contact portion 53 moves downwards with the elastic contact arm 52. After the chip 6 is positioned, the contact portion 53 is in contact with one of the signal terminals 4 for signal transmission and removing static electrons.

In the present invention, at least one of the terminals is installed in the central part of the insulating body.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric connector for connecting a chip to a circuit board comprising:

a) an insulating body;

b) at least one signal terminal located in the insulating body; and c) a grounding terminal having:

I) a flat base;

ii) an elastic contact arm inclining upwardly from the flat base;

iii) a fastening portion extending downwardly from the flat base; and iv) a contact portion selectively contacting one of the at least one signal terminal.

2. The electric connector according to claim 1, wherein the contact portion extending downwardly from a side of the flat base adjacent to the elastic contact arm.

3. The electric connector according to claim 1, wherein the insulating body has a first lateral wall extending upwardly therefrom.

4. The electric connector according to claim 3, further comprising a metal buckle, the insulating body has a second retaining wall having a retaining groove, the metal buckle is inserted into the retaining groove.

5. The electric connector according to claim 4, wherein the metal buckle has a hooking portion, the insulating body has a plurality of hooking blocks, the hooking portion and the plurality of hooking blocks selectively securing the chip in the insulating housing.

6. The electric connector according to claim 1, wherein each of the at least one signal terminal is located in a central portion of the insulation body.

7. The electric connector according to claim 1, wherein the at least one signal terminal including a plurality of signal terminals, each of the plurality of signal terminals has a conductance portion engaging a spacer of the chip, one of the plurality of signal terminals is located on one of two opposing sides of the insulating body and selectively contacting the contact portion of the grounding terminal.

* * * * *